US006514086B2

(12) United States Patent
Liao

(10) Patent No.: US 6,514,086 B2
(45) Date of Patent: Feb. 4, 2003

(54) SIGNAL CONNECTOR CAPABLE OF REDUCING ATTENUATION

(76) Inventor: Sheng Hsin Liao, No. 10, Alley 38, Lane 229, San Chun St., Shulin, Taipei Hsien (TW)

( * ) Notice: Subject to any disclaimer, the term of this patent is extended or adjusted under 35 U.S.C. 154(b) by 0 days.

(21) Appl. No.: 09/845,193

(22) Filed: May 1, 2001

(65) Prior Publication Data

US 2002/0151224 A1 Oct. 17, 2002

(30) Foreign Application Priority Data

Apr. 13, 2001 (TW) ..... 90205810 U

(51) Int. Cl.[7] ..... H01R 24/00
(52) U.S. Cl. ..... 437/676; 439/638
(58) Field of Search ..... 439/418, 430, 439/654, 676, 722, 736, 941, 721, 726, 638

(56) References Cited

U.S. PATENT DOCUMENTS 1,257,394 A * 2/1918 Reynolds ..... 439/721
5,571,035 A * 11/1996 Ferrill ..... 439/894
5,628,653 A * 5/1997 Haas et al. ..... 439/607
5,899,770 A * 5/1999 Ezawa ..... 439/418
6,331,120 B1 * 12/2001 Clement ..... 439/418

* cited by examiner

*Primary Examiner*—Gary Paumen
*Assistant Examiner*—James R. Harvey
(74) *Attorney, Agent, or Firm*—Rosenberg, Klein & Lee

(57) ABSTRACT

The present invention provides a signal connector capable of reducing attenuation, which comprises an insulating shell body, a plurality of conductive terminals, and a fixing seat. The insulating shell body has at least an insertion hole. The conductive terminals are twisted in pairs to form twisted-pair cables. Twisted portions of the conductive terminals are sheathed with insulating layers. Either end of the conductive terminal joins a contact portion. The fixing seat is sheathed and fixed at the twisted portions of the conductive terminals. The fixing seat is also fixed on the insulating shell body. A signal connector capable of reducing attenuation is thus formed. The present invention can effective reduce attenuation of signals and have a faster transmission speed and a better transmission efficiency.

6 Claims, 9 Drawing Sheets

SIGNAL CONNECTOR CAPABLE OF REDUCING ATTENUATION

FIELD OF THE INVENTION

The present invention relates to a signal connector capable of reducing attenuation and, more particularly, to a signal connector capable of effectively reducing attenuation of signals and having a faster transmission speed and a better transmission efficiency.

BACKGROUND OF THE INVENTION

As shown in FIG. 1, a prior art signal connector comprises an insulating shell body 10*a* composed of two half bodies 11*a*. Each of the two half bodies 11*a* has an insertion hole 12*a* to insert a mating connector therein. A plurality of conductive terminals 20*a* are fixed on the two half bodies 11*a* of the insulating shell body 10*a* by a fixing seat 30*a*. Contact portions 21*a* of the conductive terminals 20*a* are exposed in the insertion holes 12*a* of the insulating shell body 10*a*. Thereby, when two mating connectors (not shown) are inserted into the signal connector, the conductive terminals 20*a* will contact with conductive terminals of the two mating connectors to achieve electric connection, hence accomplishing communicating and adapting functions for the signal connector.

However, for the above prior art signal connector, because the conductive terminal 20*a* has a certain length, and the transmission speed is slower, it cannot keep up with continual growth of transmission requirement. Moreover, the conductive terminal 20*a* will result in attenuation of signals. Accordingly, the present invention aims to solve the above problems in the prior art.

SUMMARY OF THE INVENTION

The primary object of the present invention is to provide a signal connector capable of reducing attenuation, wherein conductive terminals of a signal connector are twisted in pairs to form twisted-pair cables. When the current flows in one conductive terminal of a twisted-pair cable, a magnetic field will be generated, which will interferer with the other conductive terminal. Therefore, when two conductive terminals are twisted together, the magnetic fields will cancel out each other, hence effectively reducing attenuation of signals and having a faster transmission speed and a better transmission efficiency.

To achieve the above object, the present invention provides a signal connector capable of reducing attenuation, which comprises an insulating shell body, a plurality of conductive terminals, and a fixing seat. The insulating shell body has at least an insertion hole. The conductive terminals are twisted in pairs to form twisted-pair cables. Twisted portions of the conductive terminals are sheathed with insulating layers. Either end of the conductive terminal joins a contact portion. The fixing seat is sheathed and fixed at the twisted portions of the conductive terminals. The fixing seat is also fixed on the insulating shell body. A signal connector capable of reducing attenuation is thus formed.

The various objects and advantages of the present invention will be more readily understood from the following detailed description when read in conjunction with the appended drawing, in which:

DETAILED DESCRIPTION OF THE PREFERRED EMBODIMENTS

Figure 1:
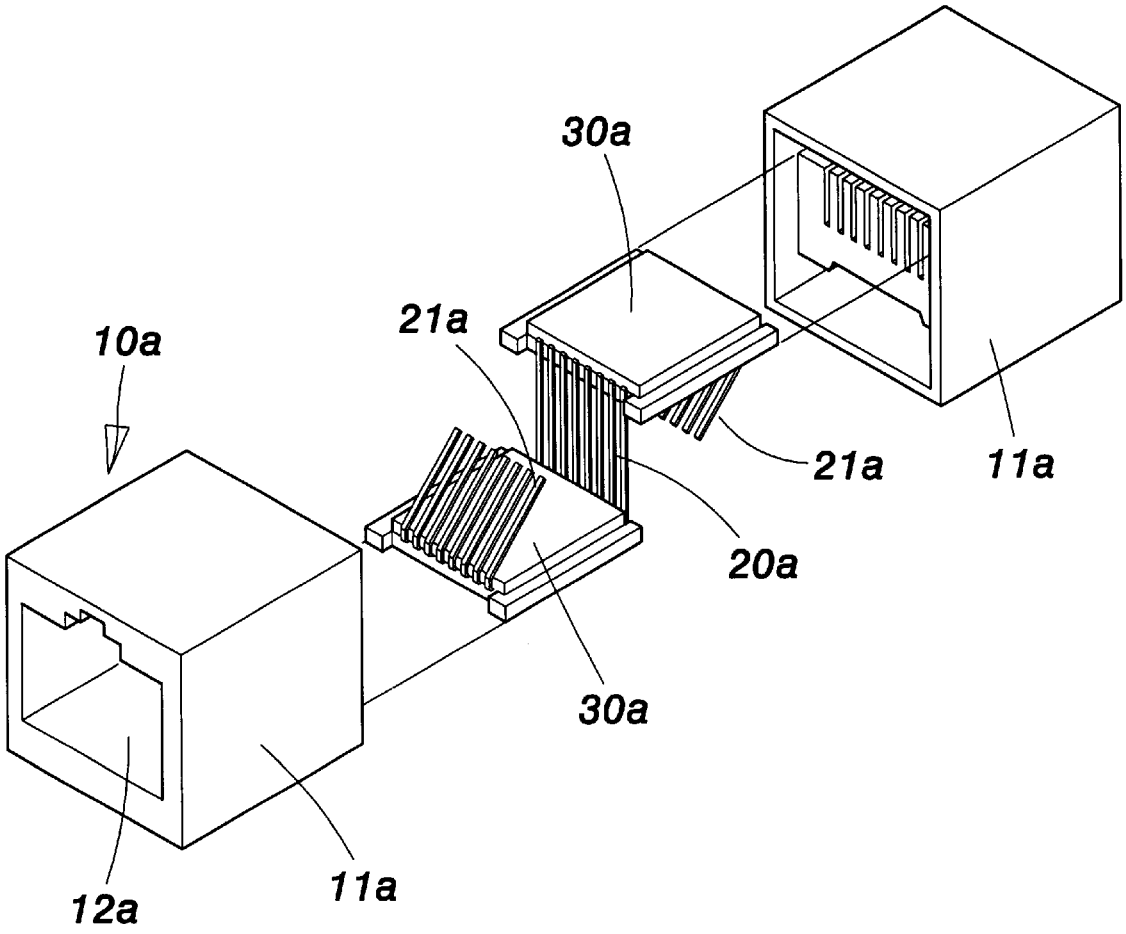
FIG. 1 PRIOR ART
FIG. 1 is an exploded perspective view of a prior art signal connector.
Figure 2:
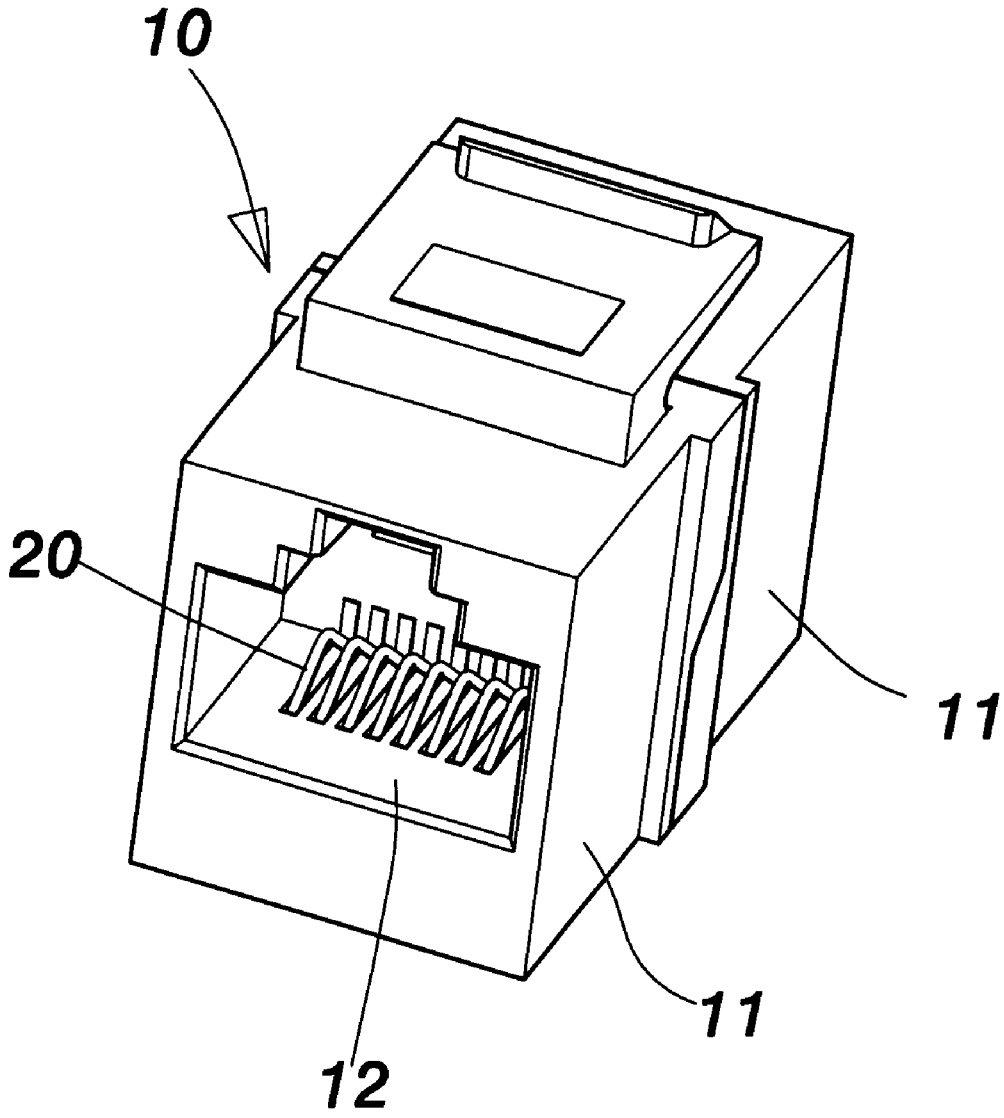
FIG. 2 is a perspective view according to a first embodiment of the present invention.
Figure 3:
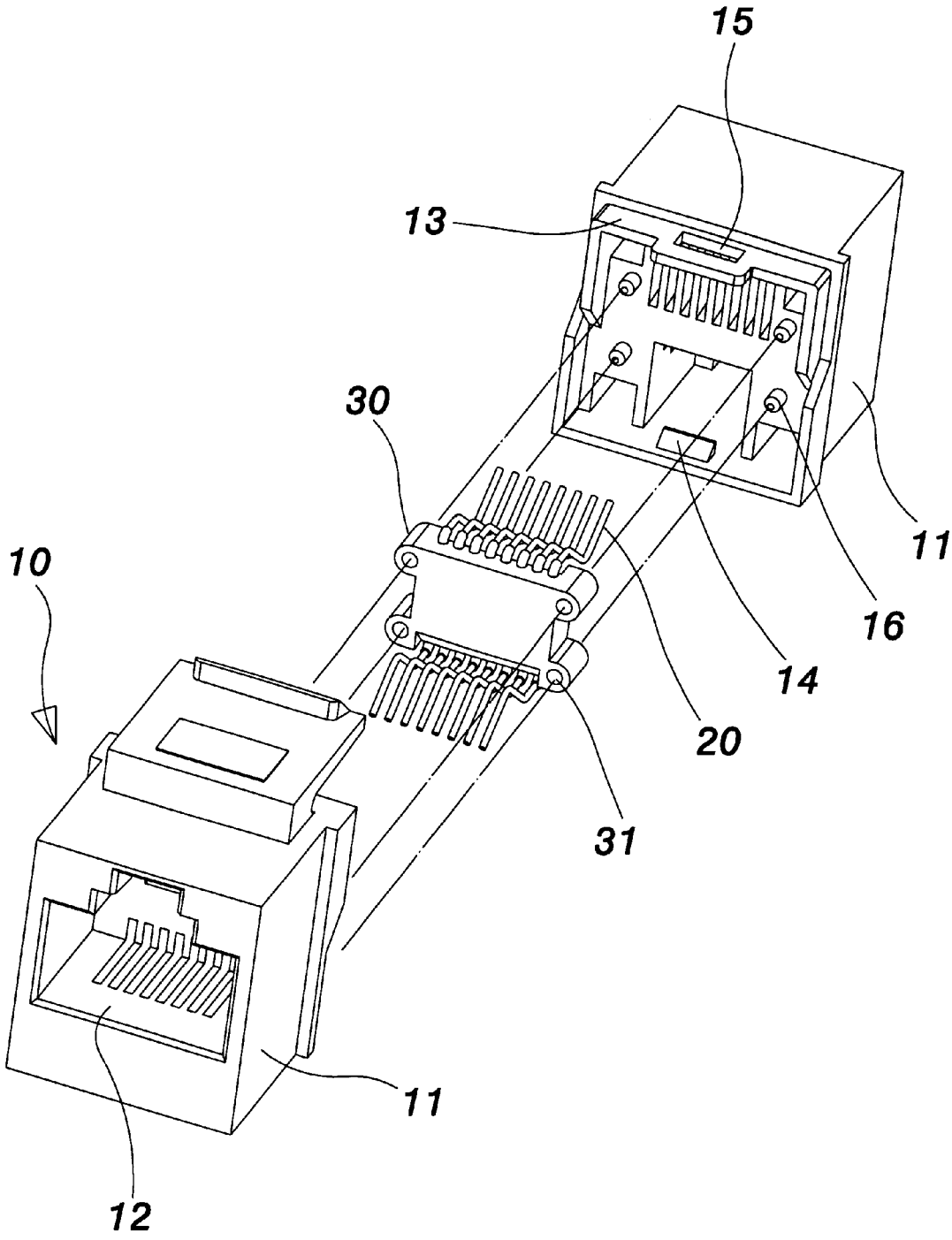
FIG. 3 is an exploded perspective view according to the first embodiment of the present invention.
Figure 5:
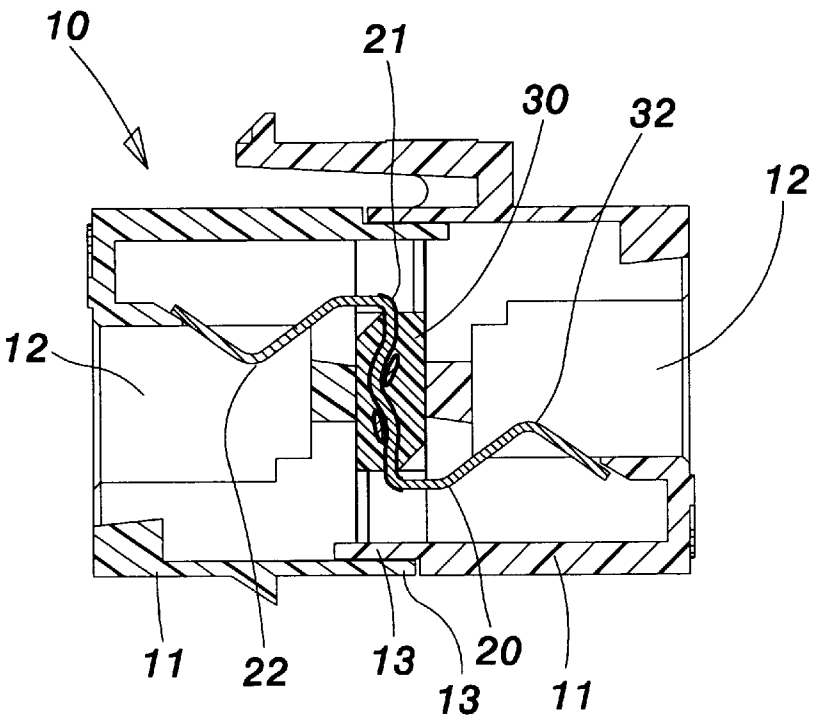
FIG. 5 is a cross-sectional view along line A—A in FIG. 4.
Figure 4:
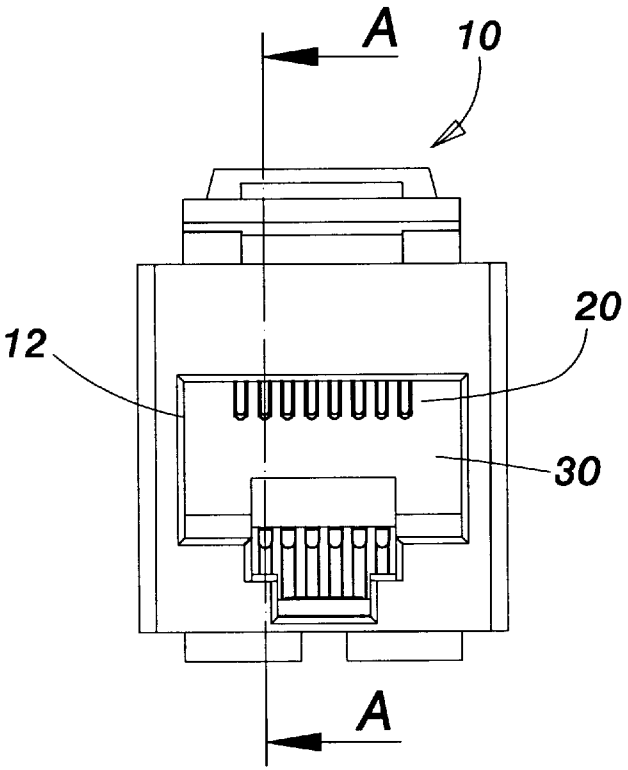
FIG. 4 is a plan view according to the first embodiment of the present invention.

As shown in FIGS. 2 to 5, the present invention provides a signal connector capable of reducing attenuation, which comprises an insulating shell body 10, a plurality of conductive terminals 20, and a fixing seat 30. The insulating shell body 10 is composed of two half bodies 11 made of plastic insulating material. The two half bodies 11 are cuboids each having an insertion hole 12 to insert a mating connector therein. The one end of each of the two half bodies 11 where they join together forms an insertion portion 13. The two insertion portions 13 can insert with each other so that the two half bodies 11 can be assembled together. Each of the two insertion portions 13 has a fastening body 14 and a fastening hole 15 thereon. The fastening bodies 14 and the fastening holes 15 of the two half bodies 11 correspond to each other. When the two half bodies 11 are assembled together, the fastening bodies 14 and the fastening holes 15 will fasten each other so that the two half bodies 11 can be firmly assembled together. Additionally, a plurality of fixing pins 16 are disposed on the joining faces of the two half bodies 11.

Figure 6:
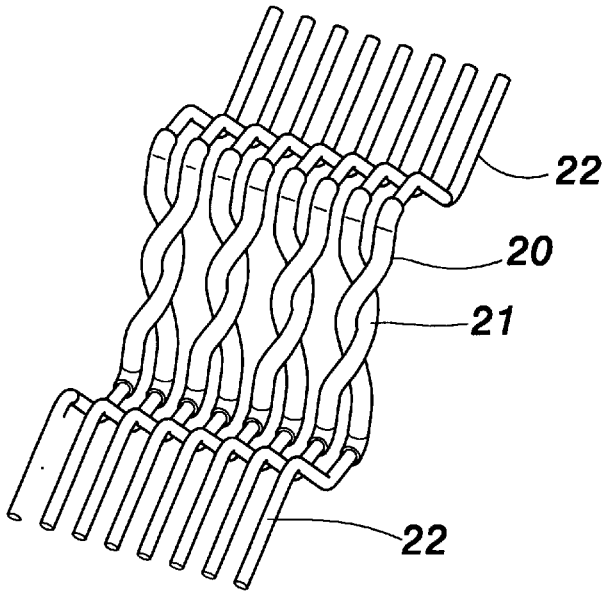
FIG. 6 is a perspective view of the conductive terminals twisted in pairs according to the first embodiment of the present invention.
Figure 7:
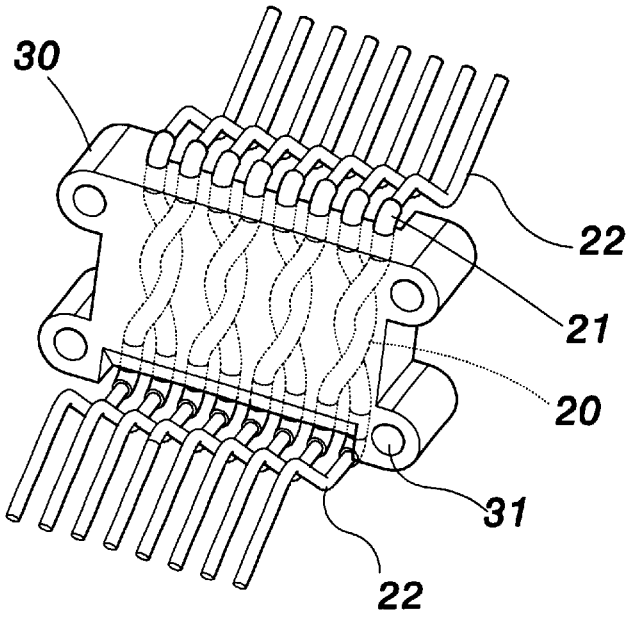
FIG. 7 is a perspective view of the conductive terminals twisted in pairs and the fixing seat according to the first embodiment of the present invention.
Figure 9:
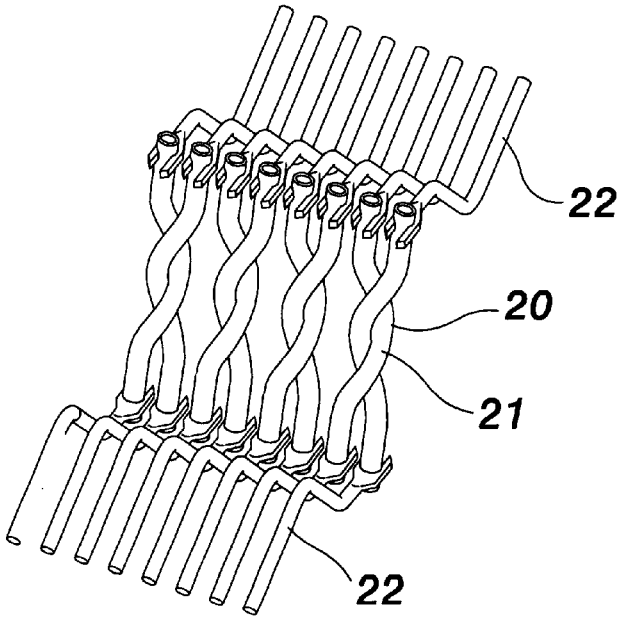
FIG. 9 is a perspective view of the conductive terminals twisted in pairs and the fixing seat according to a second embodiment of the present invention.

The conductive terminals 20 are made of copper material (please also refer to FIGS. 6 and 7). Middle portions of two conductive terminals 20 are twisted to form a twisted-pair cable. The twisted portions of the conductive terminals 20 are sheathed with insulating layers 21 to prevent short-circuiting between two twisted conductive terminals 20. Either end of the conductive terminal 20 joins a projective arc-shaped contact portion 22. As shown in FIG. 9, the conductive terminals 20 are made of softer material, so that the conductive terminals 20 and the contact portions 22 can be assembled. That is, the contact portion 22 is made of harder material, and one end of the contact portion 22 is then joined with the conductive terminal 20.

Figure 8:
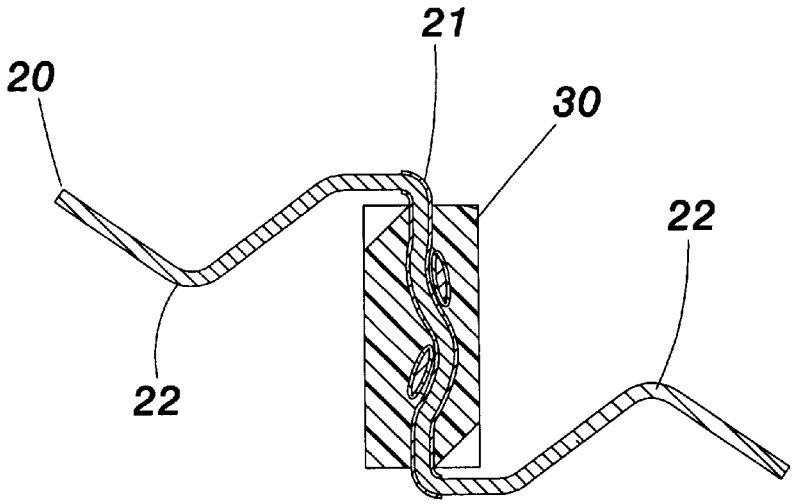
FIG. 8 is a cross-sectional view of the conductive terminals twisted in pairs and the fixing seat according to the first embodiment of the present invention.

The fixing seat 30 is made of insulating material, and is sheathed and fixed at the twisted portions of the conductive terminals 20 (please also refer to FIG. 8) so that the conductive terminals 20 can be fixed on the fixing seat 30. The fixing seat 30 has a plurality of fixing holes 31 thereon. The fixing seat 30 is locked with the fixing pins 16 of the insulating shell body 10 through the fixing holes 31 so that the fixing seat 30 can be fixed between the two half bodies 11 of the insulating shell body 10, hence fixing the conductive terminals 20 on the two half bodies 11 of the insulating shell body 10. The contact portions 22 of the conductive terminals 20 are exposed in the insertion holes 12 of the insulating shell body 10. A signal connector capable of reducing attenuation is thus formed.

Figure 10:
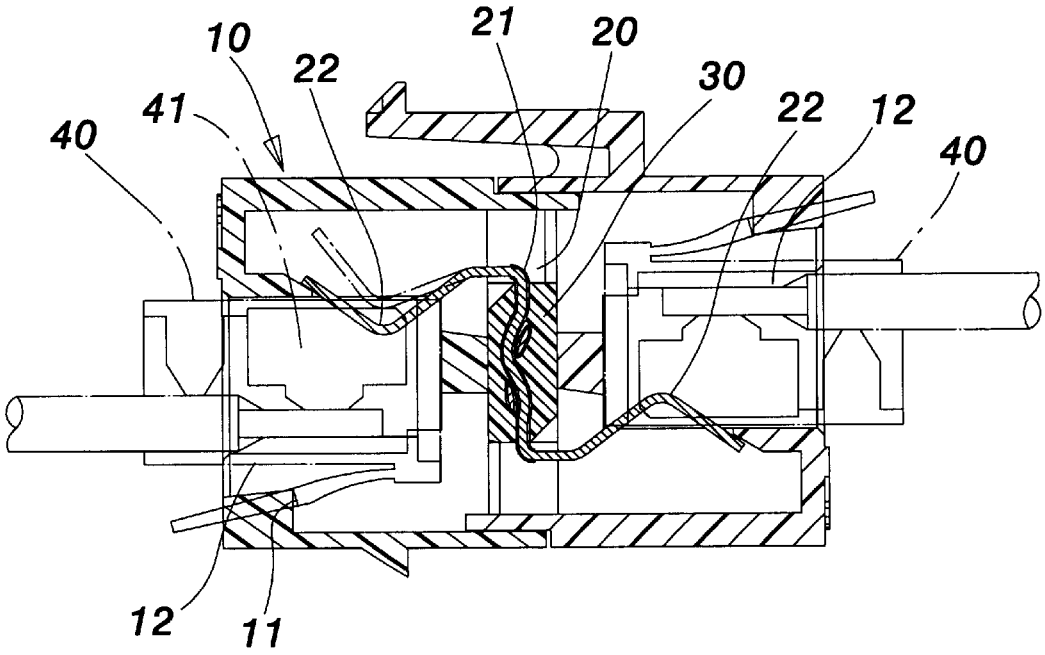
FIG. 10 is a view showing the situation that two mating connectors are inserted into the signal connector according to the first embodiment of the present invention.

As shown in FIG. 10, in the present invention, two mating connectors 40 can be inserted into the two insertion holes 12 of the insulating shell body 10 of the signal connector. When the two mating connectors 40 are inserted into the signal connector, the contact portions 22 of the conductive terminals 20 will be electrically connected to conductive terminals 41 of the two mating connectors 40, hence achieving electric connection between the two mating connectors 40 through the signal connector.

Figure 11:
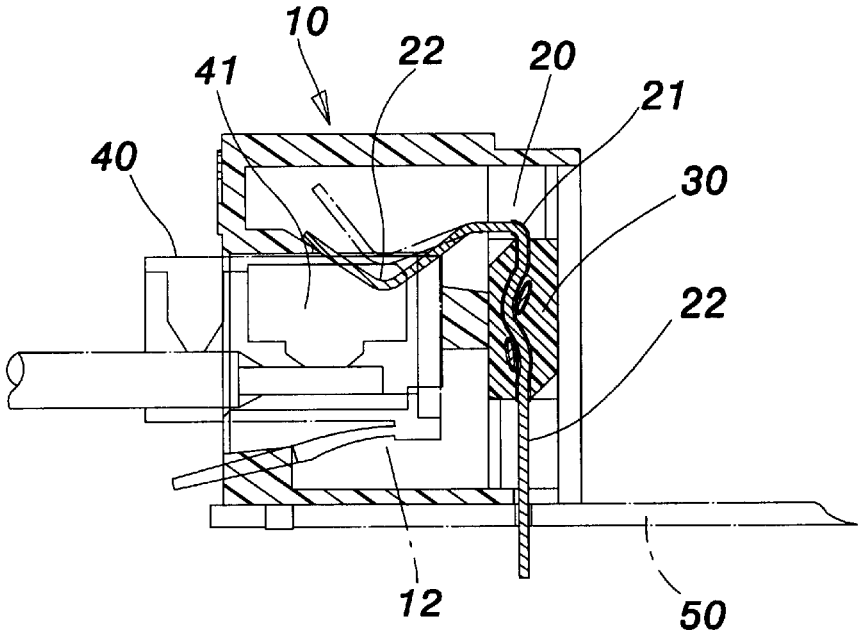
FIG. 11 is a view showing the situation that two mating connectors are inserted into the signal connector according to a third embodiment of the present invention.

Additionally, as shown in FIG. 11, the insulating shell body 10 of the present invention can also be a single body having only an insertion hole 12 to insert a mating connector therein. The conductive terminals 20 are fixed on the fixing seat 30. The fixing seat 30 is properly fixed on the insulating shell body 10 so that the conductive terminals 20 can be fixed on the insulating shell body 10. The contact portions 22 at one end of the conductive terminals 20 are exposed in the insertion hole of the insulating shell body 10. The mating connector 40 can be inserted into the insertion hole 12 of the insulating shell body 10 of the signal connector to let the contact portions 22 of the conductive terminals 20 contact with the conductive terminals 41 of the mating connector 40 to achieve electric connection. The contact portions 22 at the other end of the conductive terminals 20 protrude out of the insulating shell body 10 to be inserted into a circuit board 50, hence achieving electric connection between the mating connector 40 and the circuit board 50 through the signal connector.

Figure 12:
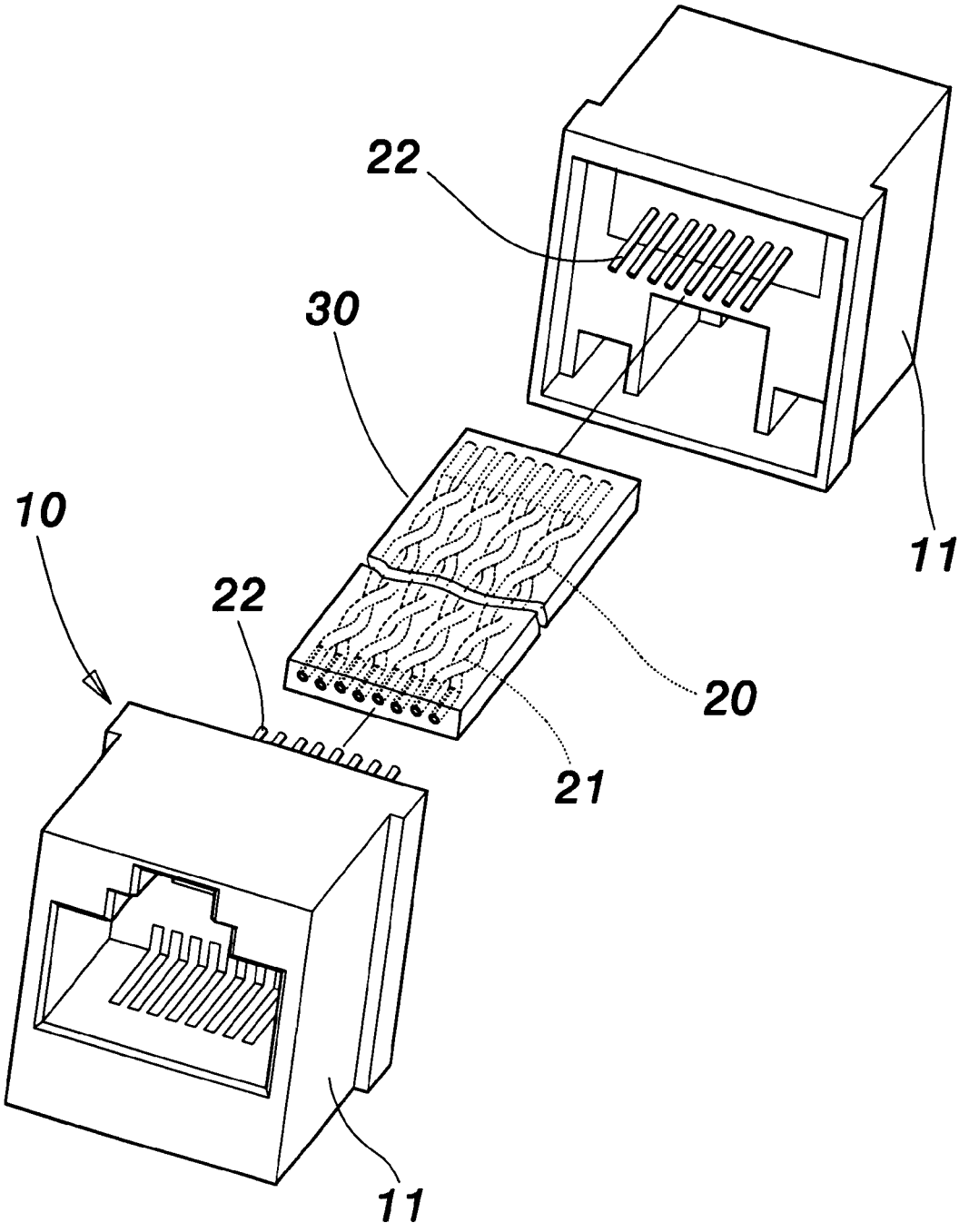
FIG. 12 is an exploded perspective view according to a fourth embodiment of the present invention.

Additionally, as shown in FIG. 12, the conductive terminals 20 and the contact portions 22 are assembled together. In other words, the conductive terminals 20 are fixed on the fixing seat 30, the contact portions 22 are fixed on the two half bodies 11 of the insulating shell body 10, and one end of the contact portions 22 are then joined with the conductive terminals 20.

Figure 13:
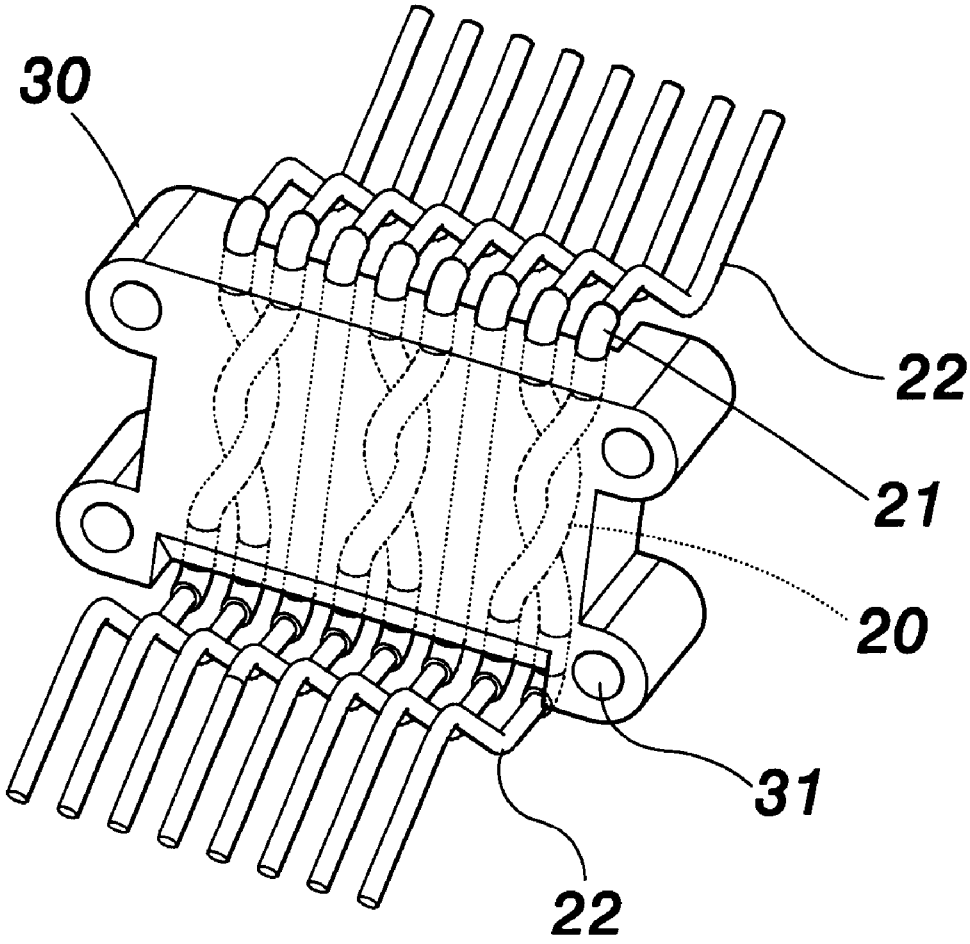
FIG. 13 is a perspective view of the conductive terminals twisted in pairs and the fixing seat according to a fifth embodiment of the present invention.

Additionally, as shown in FIG. 13, it is also feasible that parts of the conductive terminals 20 are twisted to form twisted-pair cables, while the other parts thereof are not twisted, and twisted and non-twisted conductive terminals 20 are alternately arranged.

The present invention is characterized mainly in that the conductive terminals 20 are twisted in pairs to form twisted-pair cables. When the current flows in one conductive terminal 20 of a twisted pair, a magnetic field will be generated, which will interferer with the other conductive terminal 20. Therefore, when two conductive terminals 20 are twisted together, the magnetic fields will cancel out each other, hence effectively reducing attenuation of signal and having a faster transmission speed and a better transmission efficiency.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A signal connector having reduced attenuation, comprising:

an insulating shell body having at least one insertion hole for receiving a modular plug therein;

a plurality of pairs of conductive terminals substantially disposed in said insulating shell body, each of said conductive terminals having contact portions at opposing end portions thereof and an insulated intermediate portion therebetween, said insulated intermediate portions of at least one of said plurality of pairs of conductive terminals being twisted together; and a fixing seat disposed in said insulating shell body and secured thereto, said fixing seat substantially enclosing said insulated intermediate portions of said plurality of pairs of conductive terminals, said fixing seat securing said plurality of pairs of conductive terminals to said insulating shell body with said contact portions at a first of said end portions of said conductive terminals being extended into said insertion hole for electrical contact with corresponding conductors of the modular plug.

2. The signal connector as claimed in claim 1, wherein said insulating shell body is composed of two half bodies, one end of each of said two half bodies being respectively formed with two insertion portions for mating one half body with the other, each of said two insertion portions of each of said half bodies respectively having a fastening body and a fastening hole, said fastening body of each of said half bodies being respectively engaged with said fastening hole of said other of said half bodies.

3. The signal connector as claimed in claim 1, wherein said insulating shell body has a plurality of fixing pins thereon, said fixing seat having a plurality of fixing holes formed therein, said fixing pins of said insulating shell body being passed through said fixing holes to secure said fixing seat to said insulating shell body.

4. The signal connector as claimed in claim 1 wherein said insulating shell body has a pair of insertion holes and said contact portions at each of said opposing end portions of each of said conductive terminals are respectively exposed in said pair of insertion holes of said insulating shell body to provide a electrical coupling between corresponding conductors of a pair of modular plugs respectively received within said pair of insertion holes.

5. The signal connector as claimed in claim 1, wherein at least a portion of said contact portions at a second of said end portions of said conductive terminals respectively protrude out of said insulating shell body for coupling to a circuit board.

6. A signal connector having reduced attenuation, comprising:

an insulating shell body having a pair of insertion holes respectively formed therein;

a plurality of pairs of conductive terminals disposed in said insulating shell body, each of said conductive terminals having contact portions at opposing end portions thereof and an insulated intermediate portion therebetween, said insulated intermediate portions of each of said pairs of conductive terminals being twisted together; and a fixing seat disposed in said insulating shell body and secured thereto, said fixing seat enclosing said twisted portions of said pairs of conductive terminals, said fixing seat securing said plurality of pairs of conductive terminals to said insulating shell body with said contact portions at a first of said end portions of said conductive terminals being extended into one of said pair of insertion holes and said contact portions at a second of said end portions of said conductive terminals being extended into the other of said pair of insertion holes for providing electrical coupling between corresponding conductors of a pair of modular plugs respectively received within said pair of insertion holes.

* * * * *